US007100478B2

(12) United States Patent
Davis

(10) Patent No.: US 7,100,478 B2
(45) Date of Patent: Sep. 5, 2006

(54) WRENCH

(75) Inventor: Jerry Anthony Davis, Destrehan, LA (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/806,696

(22) Filed: Mar. 23, 2004

(65) Prior Publication Data

US 2005/0211028 A1 Sep. 29, 2005

(51) Int. Cl.
*B25B 13/02* (2006.01)

(52) U.S. Cl. ..... 81/176.15; 81/177.1; 81/53; 81/119; D8/21; D8/28; 411/402

(58) Field of Classification Search ..... 81/53, 81/58, 121.1, 119, 177.1, 124.3, 124.4, 124.5, 81/124.6, 186, 176.15; D8/21, 28, 29; 411/402–405, 411/410

See application file for complete search history.

(56) References Cited

U.S. PATENT DOCUMENTS 2,909,090 A * 10/1959 Moore ..... 81/176.15
3,768,345 A * 10/1973 Barnes ..... 81/176.15
4,181,048 A 1/1980 Norton ..... 81/90 C
4,237,755 A 12/1980 Gunnell, III ..... 81/90 C
5,772,373 A * 6/1998 Cronin et al. ..... 411/120
5,839,331 A 11/1998 Rocheleau ..... 81/176.15
6,101,904 A 8/2000 Freitas ..... 81/121.1
6,701,807 B1 * 3/2004 Gammon ..... 81/119

FOREIGN PATENT DOCUMENTS

GB 2318315 4/1998

* cited by examiner

*Primary Examiner*—Lee D. Wilson
*Assistant Examiner*—Anthony Ojini
(74) *Attorney, Agent, or Firm*—Charles W. Stewart

(57) ABSTRACT

A socket for easily connecting and disconnecting a standard camlock fitting, such as those used in flanges on marine vessels, includes four drive lugs, or tangs, for mating with recesses on the camlock. The socket is adapted for connection to a standard ratchet wrench for providing torque to tighten or loosen the camlocks.

6 Claims, 5 Drawing Sheets

WRENCH

BACKGROUND OF THE INVENTION

1. Field of the Invention

The invention is related to tools for connecting and disconnecting flanges such as those used at a refinery or on a barge.

2. Description of Related Art

U.S. Pat. No. 6,101,904 discloses an improved flange removal tool for facilitating the installation and removal of pipe flanges from a receiving pipe fitting. The flange tool includes a body portion with an upper surface which includes a central opening for receiving an engagement head of a socket wrench. A continuous frame is attached to the body portion by spaced arms such that the continuous frame is suspended in spaced relation from the lower surface of the body portion by a distance which is greater than the thickness of a pipe flange to be rotated. The pipe flange is positioned between the body portion and the frame so that upon rotation of the flange tool, facilitated by engagement of a socket wrench with the central opening, side walls of the spaced arms contact the edges of the pipe flange to urge rotation thereof and threading onto its receiving pipe fitting.

U.S. Pat. No. 5,839,331 discloses a flange tightening tool for use in securing a flange to a pipe. The tool has a base plate, a tightening hexagonal shoulder, two attachment openings, two quick release disconnect mechanisms and a rotating handle perpendicular to the tightening base plate. The hexagonal shoulder enables the tool to be used with a companion lightweight wrench. The tool can also be used with an open end wrench or an adjustable wrench. A rotatable handle is attached to the hexagonal shoulder such that said handle is perpendicular to the face of a flange that is to be tightened and can be used to hold the tool against the flange. When the quick release disconnect mechanisms are depressed about the pivot pin the quick release disconnect mechanism detracts from the mounting members releasing the mounting member separating the base plate and the flange. The tool prevents over tightening since the flange cannot be tightened past the point where the pipe contacts the base plate. An adapter plate enables the tool to be used with an additional size of flange.

In U.S. Pat. No. 4,237,755 the pipe flange tool for tightening or removing threaded pipe flanges includes a base having at least three engaging pins laterally extending from one side of the base and means for rotationally engaging the base. The engaging pins are positioned on the base such that at least two of the pins cooperate to tighten or remove various threaded pipe flanges as are commonly used for forming circulating pumps to pipes. The tool base may be provided with a bore in the base itself or it may have a laterally extending hub having a bore sized to receive a conventional socket wrench. The base may also be provided with pins having various configurations including cylindrical or frusto-conical.

U.S. Pat. No. 4,181,048 discloses a flange turning tool adapted for use with flanged pipe couplings, wherein the wrench comprises a head member having a reduced, extending, jaw member which is provided with a cylindrical key pin that extends laterally and outwardly therefrom. The key pin is arranged to be received in any one of a plurality of openings located about the flange member of the pipe coupling. The annular periphery of a thrust flange will engage the shoulder defined by the rear enlarged portion of the head member. The head member has a threaded bore to receive a conventional bar or extension handle. When force is applied to the bar, the flange is locked between the key pin and shoulder and is then either tightened or untightened, depending on the direction of force applied thereto.

British Patent GB 2,318,315 relates to a device for securing a threaded flange to the threaded end portion of a pipe.

SUMMARY OF THE INVENTION

A socket for easily connecting and disconnecting a standard camlock fitting, such as those used in flanges on marine vessels, includes four drive lugs, or tangs, for mating with recesses on the camlock. The socket is adapted for connection to a standard ratchet wrench for providing torque to tighten or loosen the camlocks.

DESCRIPTION OF PREFERRED EMBODIMENTS

Figure 1A:
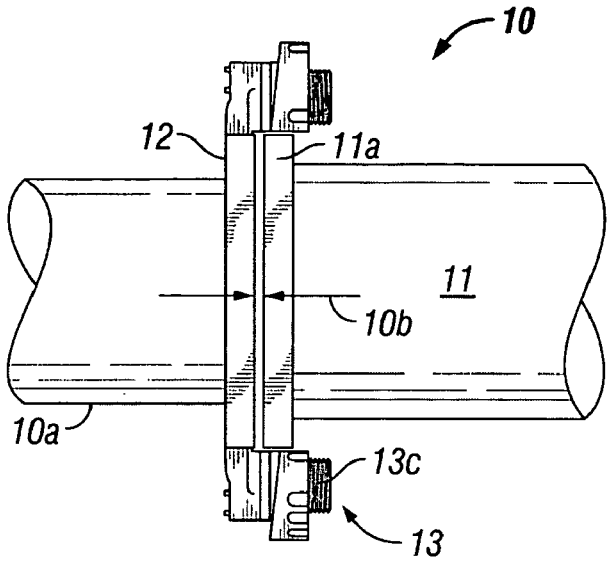
FIG. 1A is a side elevation view of a standard camlock flange coupling in initial engagement with a mating flange with the camlocks fully open for receiving a mating flange.
Figure 1B:
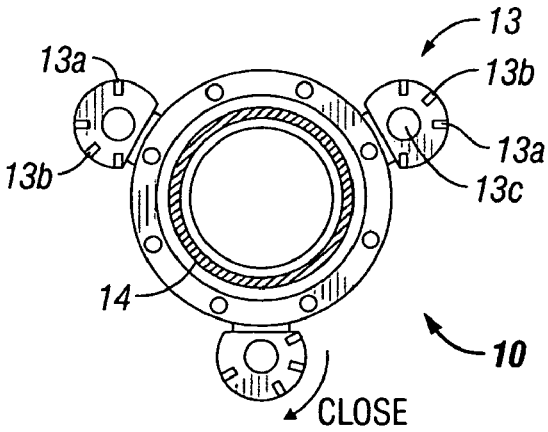
FIG. 1B is a front elevation view of the camlock flange coupling with the camlocks fully open.
Figure 1C:
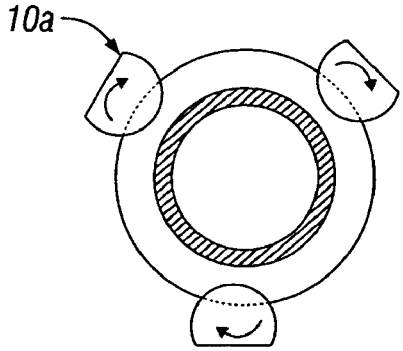
FIG. 1C is a depiction of the flange with camlocks in their engaged (tightened) position.
Figure 2A:
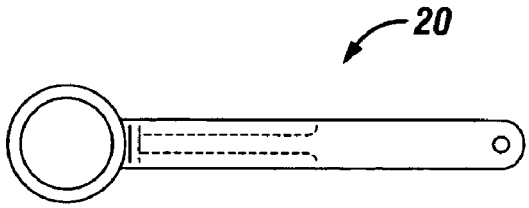
FIG. 2A (Prior Art)
FIG. 2A is a plan view of a prior art wrench used for tightening the camlocks.
Figure 2B:
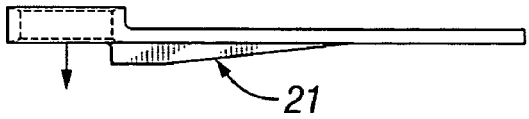
FIG. 2B (Prior Art)
FIG. 2B is a side view of the wrench of FIG. 2A.
Figure 2C:
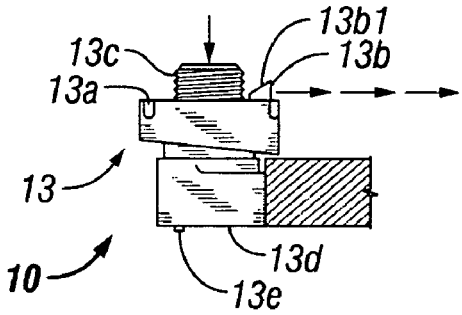
FIG. 2C (Prior Art)
FIG. 2C is a side view of a camlock in alignment with the wrench of FIGS. 2A and 2B.

Referring now to FIG. 1, a standard camlock flange coupling 10, well known to those skilled in the art is shown. The coupling 10 may be affixed to a pipe manifold side or to the end of a connection hose. For ease of illustration, flange coupling 10 is shown as being fixedly attached, such as by welding 12, to coupling pipe 10*a*. Couplings 10 are also available in studded and slip-on types. Coupling 10 also comprises a plurality of camlocks 13 also well known by those skilled in the art. Each camlock 13 comprises a plurality of turning slots 13*a* (shown more clearly in FIG. 1B and in FIG. 4) and a ratchet lock pawl 13*b* and are threaded onto cam bolt pins 13*c*. It will be appreciated that ratchet pawl 13*b* is shown in its locked position and includes an inclined face 13*b*1 to facilitate an unlocking movement when engaged by a wrench. The coupling 10 also includes an o-ring 14 for sealing the mating flange surfaces. When it is desired to attach a pipe 11 having a flange 11*a* to the coupling 10, the camlocks 13 are positioned in their fully open position as shown in FIG. 1B. When the surface of flange 11*a* comes into close proximity with the face of coupling pipe 10*a*, such as at 10*b*, the camlocks 13 may be tightened by hand onto their threaded bolt pin 13*c* (by depressing pawl 13*b*) and, after hand tightening, are subsequently tightened by a wrench such as wrench 20 shown in FIG. 2. As the wrench is applied over the bolt head, the spring-loaded pawl 13*b* will be pushed back to a non-ratchet position when the wrench tang 21 engages one of the turning slots 13*a*. The camlock 13 is locked by rotation in the clockwise direction. When the wrench 20 is removed, the pawl 13*b* will automatically engage a ratchet wheel fixed to the stationary cam bolt thereby locking the cam in place. FIG. 2 shows a wrench 20 which is well known to those skilled in the art. The wrench 20 includes a tang 21 for mating with the tang turning slot 13*a* for further tightening. It will be noticed that the wrench 20 includes only one such tang 21 thereby limiting the possible mating positions with the turning slot 13*a*. The pawl 13*b*, grease fittings 13*d* and cam bolt pins 13*e* are well known in the art.

Figure 3:
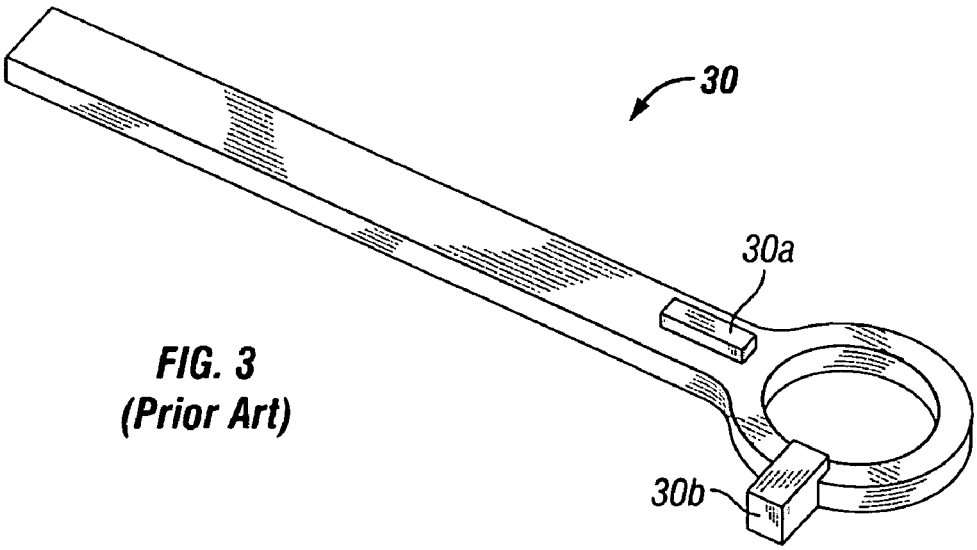
FIG. 3 (Prior Art)
FIG. 3 is a perspective view of another prior art wrench.

Referring now to FIG. 3, another prior art wrench is shown having turning tangs (or lugs) 30*a* and 30*b*. This wrench provides a more positive turning action but is still limited by the mating positions available.

Figure 4:
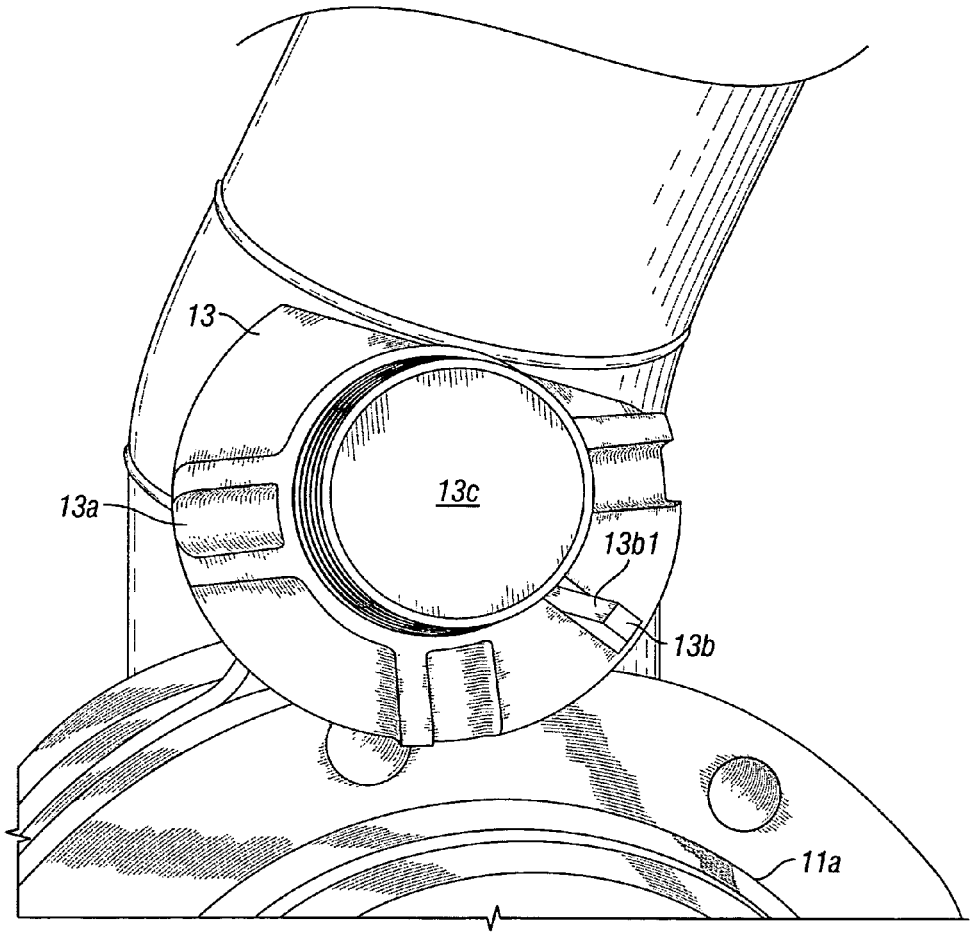
FIG. 4 is a perspective view of a camlock beginning engagement with a mating flange.

FIG. 4 shows a camlock 13 partially tightened onto a mating pipe flange 11*a*. Note that, since no wrench is attached over the camlock 13, the ratchet pawl 13*b* is fully extended, thereby locking the cam 13 in place.

Figure 5:
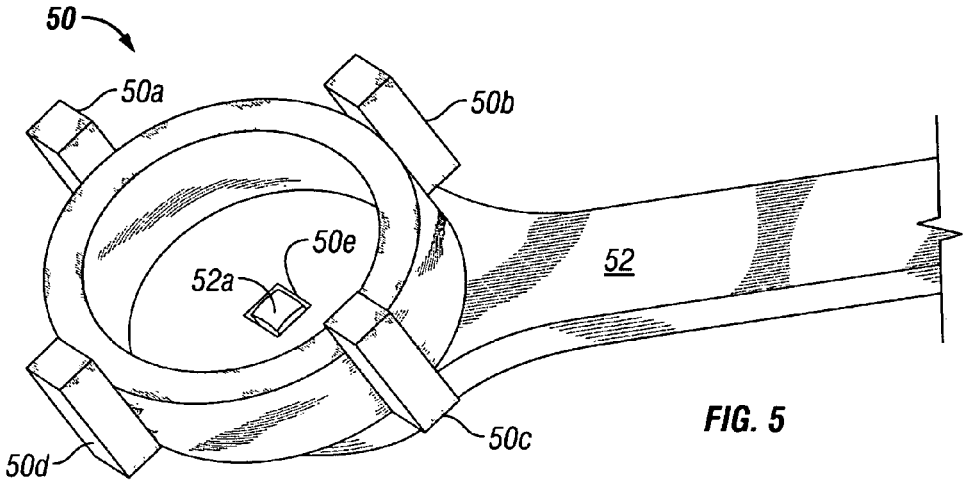
FIG. 5 is a perspective view of a socket according to the present invention.

Referring now to FIG. 5 a socket 50 according to the present invention includes a plurality of lugs or turning tangs 50*a*–50*d* evenly spaced around the periphery of the socket 50 and includes the usual ratchet drive fitting 50*e*. A ratchet wrench 52 is shown engaged with the socket 50 in the usual manner with the engagement head 52*a* of ratchet wrench 52 protruding into the ratchet drive fitting 50*e* of socket 50.

Figure 6A:
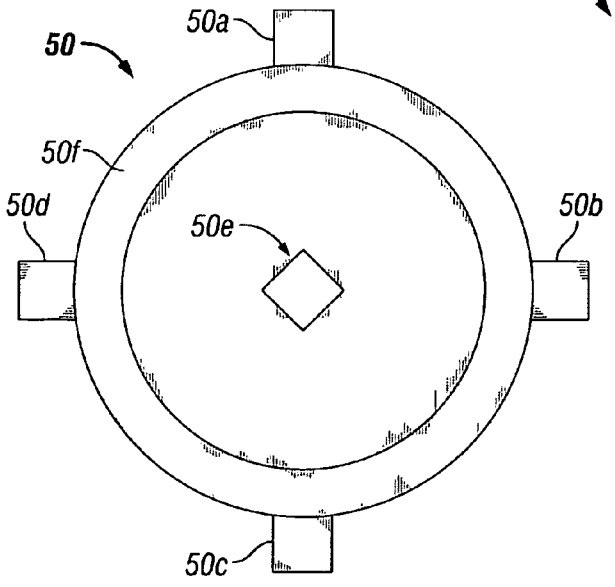
FIG. 6A is a plan view of the socket of FIG. 5.
Figure 6B:
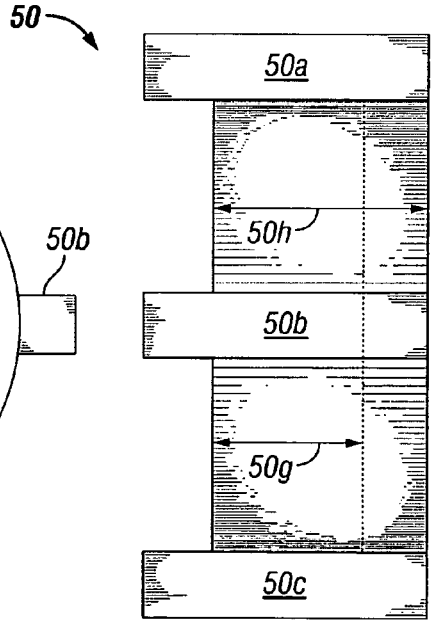
FIG. 6B is a side view of the socket of FIG. 6A.

Refer now to FIGS. 6A and 6B which show plan and side views, respectively, of the socket 50 having an overall depth 50*h*. As the shoulder 50*f* of socket 50 engages the ramp 13*b*1 of pawl 13*b*, the pawl is pushed outwardly, as shown by the arrows in FIG. 2C, thereby allowing the cam 13 to be turned, i.e., tightened or loosened. The dimension 50*g* and inner diameter of shoulder 50*f* are selected such that when the socket 50 is fully seated over a camlock 13, the ratchet lock pawl 13*b* will be completely depressed into camlock 13 by the shoulder 50*f* of socket 50 thereby disengaging the ratchet wheel of the stationary cam bolt and allowing rotation of the cam 13.

Figure 7:
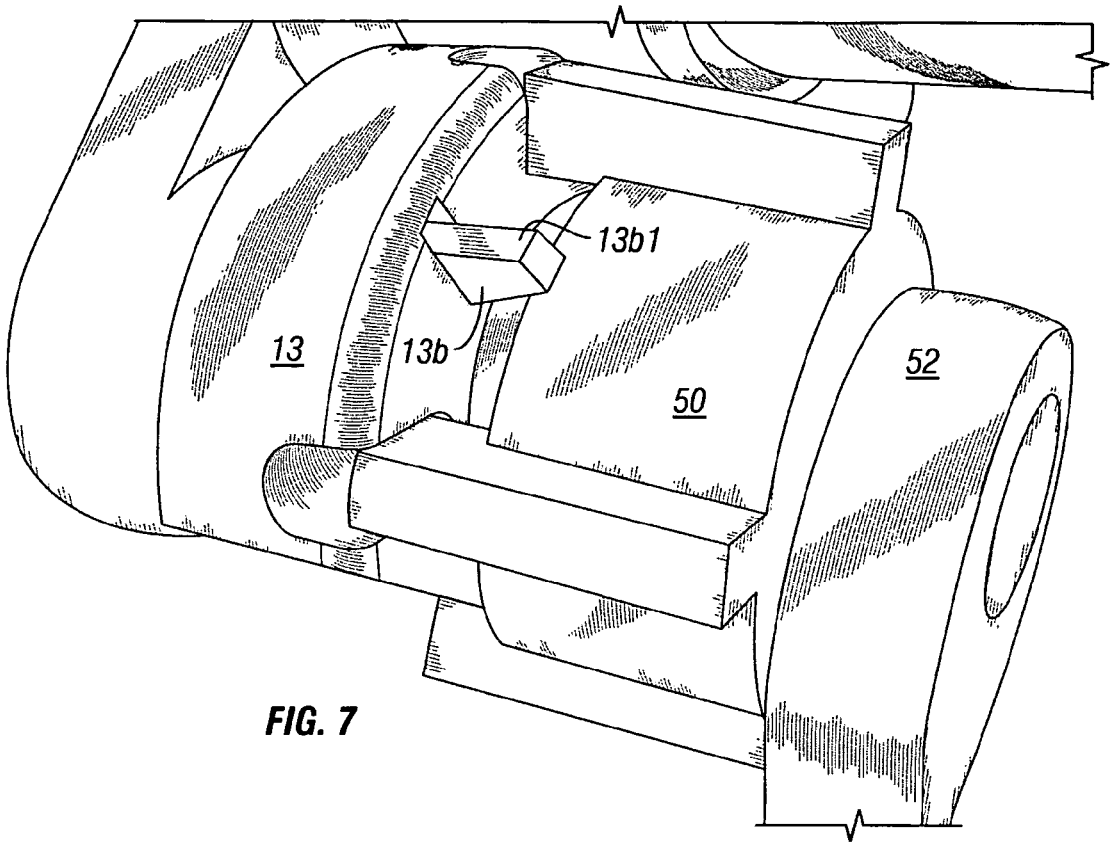
FIG. 7 is a perspective view of the socket of FIG. 5 beginning engagement with a camlock.

FIG. 7 is a perspective view of a socket 50 in accordance with the invention shown in FIGS. 5 and 6, partially seated on a camlock 13. A ratchet wrench 52 is shown in place for tightening of the camlock 13. It will be appreciated that, since pawl 13*b* is not fully depressed by shoulder 50*f* of socket 50, the cam 13 is not free to turn.

Figure 8:
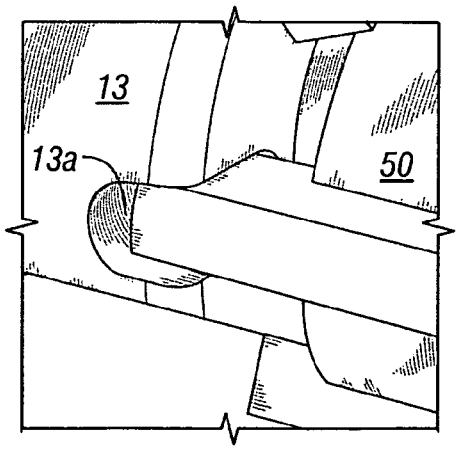
FIG. 8 is a close-up view of the engagement mechanism of the socket of FIG. 5 with the camlock.

FIG. 8 shows a close-up view of a lug or tang 52*a*–*d* in mating engagement in a cam turning slot 13*a*. In this position, the pawl 13*b* is completely pushed outwardly by the shoulder 50*f*, therefore the cam 13 is free to turn.

What is claimed is:

1. A socket for use with a ratchet wrench comprising:

a socket body having a hollowed-out potion for receiving therein and surrounding the threaded cam bolt of a standard camlock on a camlock coupling, said standard camlock comprising a plurality of turning slots recessed into the face of said camlock, and a ratchet lock pawl;

a ratchet drive fitting for receiving an engagement head of a standard ratchet wrench and for driving said socket with said standard ratchet wrench; and a plurality of tangs for engaging with cam said plurality of turning slots of said standard camlock.

2. The socket of claim 1 further including:

A shoulder on said socket body for engaging with and depressing said ratchet lock pawl on said camlock, said shoulder having an inner diameter such that when said socket is fully seated over said camlock, said ratchet lock pawl will be depressed.

3. The socket of claim 2 wherein said plurality of tangs is four.

4. The socket of claim 3 wherein said plurality of tangs is evenly spaced around the periphery of said socket.

5. The socket of claim 1 wherein said plurality of tangs is four.

6. The socket of claim 1 wherein said plurality of tangs is evenly spaced around the periphery of said socket.

* * * * *